US006576822B1

(12) United States Patent
Grace

(10) Patent No.: US 6,576,822 B1
(45) Date of Patent: Jun. 10, 2003

(54) STABLE SUPPORT FOR STRINGED INSTRUMENT

(76) Inventor: Jeff Grace, 74 Dogwood Rd., Dover, AR (US) 72837

( * ) Notice: Subject to any disclaimer, the term of this patent is extended or adjusted under 35 U.S.C. 154(b) by 0 days.

(21) Appl. No.: 10/086,261

(22) Filed: Feb. 28, 2002

(51) Int. Cl.[7] ..... G10G 5/00; G10D 3/00

(52) U.S. Cl. ..... 84/327; 84/327; 84/421; 84/387 A; 84/453

(58) Field of Search ..... 84/327, 421, 387 A, 84/329, 453

(56) References Cited

U.S. PATENT DOCUMENTS 1,907,238 A * 5/1933 Blondin ..... 84/327
4,147,254 A * 4/1979 Bruce ..... 206/314
4,205,818 A * 6/1980 Lawler ..... 248/460
D261,703 S * 11/1981 Plummer ..... D6/449
4,693,161 A * 9/1987 Uhrig ..... 84/327
5,029,796 A * 7/1991 Schoenig ..... 248/443
5,383,634 A * 1/1995 Liao ..... 248/166

* cited by examiner

*Primary Examiner*—Shih-Yung Hsieh
(74) *Attorney, Agent, or Firm*—Dennis B. Haase

(57) ABSTRACT

The present invention is a stand constructed primarily to support a stringed musical instrument in a generally upright, readily accessible position. The stand further protects the instrument from inadvertent rotation by providing spaced supports which engage the rear elements of the instrument to support the instrument in a fixed position.

17 Claims, 2 Drawing Sheets

STABLE SUPPORT FOR STRINGED INSTRUMENT

The present invention relates generally to supports for stringed instruments, e.g., cellos, and, more particularly, to such a stand which provides a stable environment which permits ready access to the instrument when needed and excellent support when not in use, while accenting the innate beauty of the instrument itself.

BACKGROUND OF THE INVENTION

1. Field of the Invention

String instruments, such as violins and cellos, tend to be more delicate than woodwinds or brass instruments and are of a shape that does not lend itself readily to convenient storage when not in immediate use. They are typically made from especially treated woods and many believe that their tone quality actually improves with age.

In the current age of impatience, the emphasis seems to be on noise rather than tonal quality and being able to create "sounds like" notes electronically is simply good enough. One can, today, for example, unfold his or her electronic keyboard and in a matter of seconds seemingly have an entire band or orchestra at one's fingertips by flipping a couple of switches.

Despite the clamor for instant gratification, there is still a significant segment of society which appreciates, for example, the renderings of a string quartet, or an orchestra, as opposed to a rock band.

Fine instruments require special care, not only because of the inherent cost, but because their quality often bears a direct relationship to the care given.

Those who appreciate fine music are no less immune from the frenetic pace of modern life than those who create the music, and that means finding a way to place an instrument at rest when not in use, while being able to return it to service quickly, unobtrusively and with no inadvertent contact with obstacles which might be in the way.

2. Overview of the Prior Art

One does not, e.g., attach a neck strap between a point on the main body and the scroll to support an instrument around one's neck when not being played. What has become the norm among serious musicians amounts to little more than a carrying case, or box, modestly padded, and capable of being upstanding so as to permit access to the instrument within.

It will be appreciated that reaching into a box to retrieve an instrument such as cello, or like instrument, is a potentially clumsy and, perhaps, damaging movement, which, if performed before an audience, could well provide an additional element of otherwise unnecessary and distracting embarrassment.

There has been some effort on behalf of inventors to address the problems under consideration, reflected, for example, in Herring, Jr. U.S. Pat. No. 6,145,801, which appears to be a modern version of a carrying case which uses, as part of its structure, an instrument stand to position it at an acute angle relative to the stage or other surface.

Urhig, in his U.S. Pat. No. 4,693,161, offers what appears to be a simple tripod type stand which is permanently affixed to the instrument itself, supporting the instrument along the back of the main body at an acute angle relative to the stage or other flooring.

While such a device may be very convenient to the extent that you pick up and set down the instrument frequently, it also means that the musician carries with him, or her, the additional load wherever they go, and if the legs do not remain flush while the instrument is in use, they are prone to get tangled up in microphone wires and other paraphernalia which could create some tense, if not embarrassing, situations.

Schoenig, in his U.S. Pat. No. 5,029,796, discloses a tripod type stand which is collapsible, so as to be portable, and is characterized by the provision of a yoke 14 which is foldable into alignment with the other parts of the stand when not in use. Neither Schoenig, nor the other patents referenced, nor other stands available to the cellist or other musicians, provides the stability and support which these instruments require and which is provided by the present invention, as will now become apparent.

SUMMARY OF THE INVENTION

The present invention is a simple, yet highly utilitarian, stand for supporting a string instrument, having as one of its principal objectives the positioning of that instrument, such as a cello, for immediate access by the musician, as needed, and a support when not in use. It will be appreciated that while it was developed for a cello, it could readily serve very efficiently as a stand for a viola, certain guitars, or even a violin or base.

It is another objective of the present invention to provide a stand which supports a string instrument such as a cello, along its rear surface in a manner which will not restrict access in any way and, in a related objective, will not cause damage or harm to the instrument, or mar the finish, despite repeated placement on the stand. Relative to the foregoing, the stand inhibits inadvertent rotation of the instrument while on the stand by providing widely spaced support points for the instrument.

Another, and further, objective of the present invention is to provide a stand which compliments, while permitting the full beauty of the instrument to be appreciated, and at the same time permitting the other objectives enumerated above to be fully implemented.

Other objectives and advantages of the stand of the present invention will become evident to those skilled in the art from a reading of the Detailed Description of a Preferred Embodiment, taken in conjunction with the drawings, wherein:

DETAILED DESCRIPTION OF A PREFERRED EMBODIMENT

Figure 1:
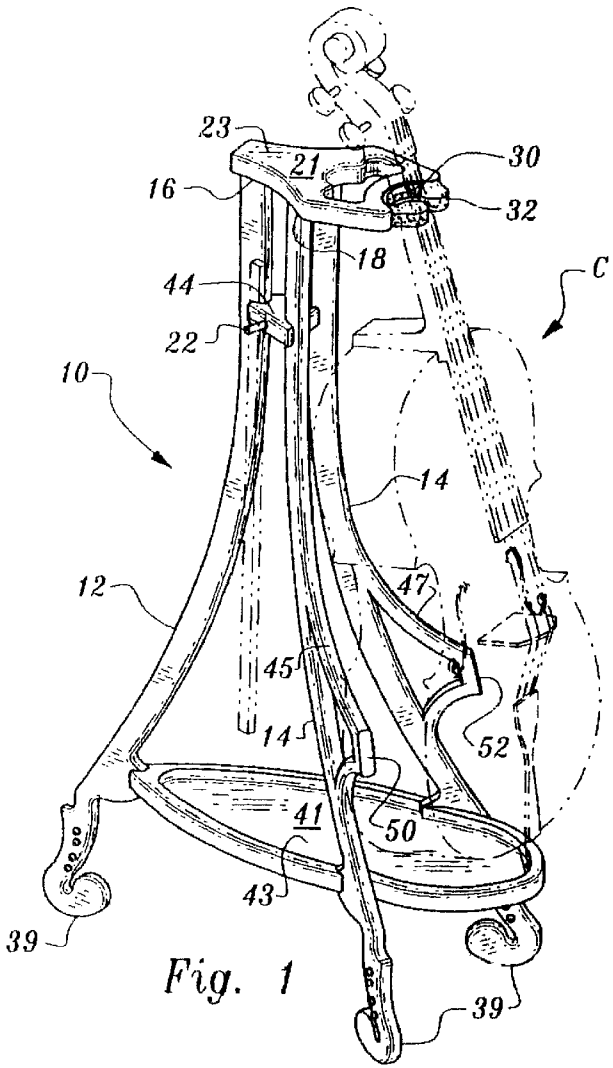
FIG. 1 is a right side elevation of a stand, shown in perspective, constructed in accordance with the present invention, with a stringed instrument, in this instance a cello, shown in shadow and generally facing the viewer on the stand, illustrating the manner in which the stand supports the instrument
Figure 4:
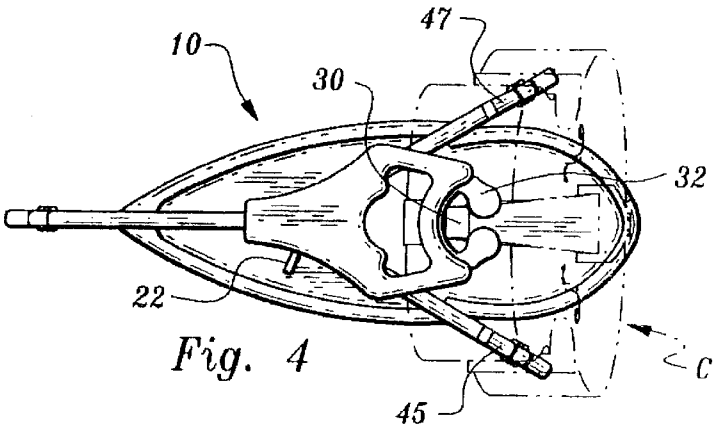
FIG. 4 is a top plan view of the stand of the present invention taken along lines 4—4 of FIG. 3; and, FIG. 5 is a partial sectional view taken along lines 5—5 of FIG. 3.
Figure 5:
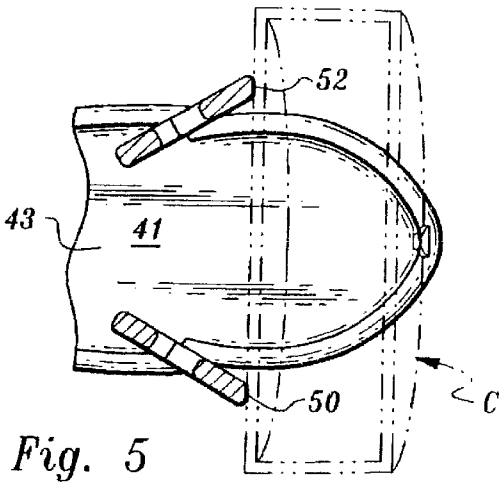
Figure 3:
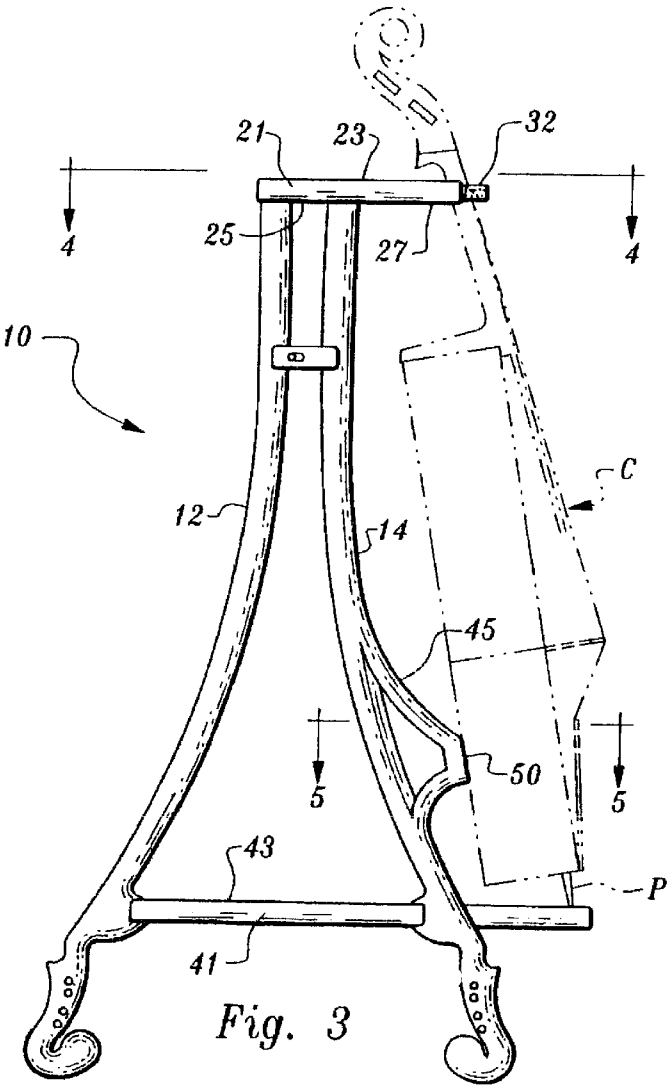
FIG. 3 is a right side elevation of the stand, with the instrument transverse to the line of sight of the viewer.

With reference now to the drawings, and initially to FIG. 1, the stand 10, constructed in accordance with the present invention, is illustrated in some detail.

The stand 10 is expressly constructed to support a stringed instrument, such as a cello C, in an upright, ready to play position, i.e., the instrument is quickly and easily retrieved from the stand in an essentially upright position, ready to play.

The stand is preferably constructed of a fine hardwood in keeping with the objective of providing an exceptionally attractive stand which will compliment a fine string instrument. It will be appreciated, however, that the use of other materials is anticipated and is within the scope of the invention.

The stand 10 comprises a pair of generally arched or arcuate load bearing braces, or struts, specifically a rear strut 12 and a pair of forward struts 14. Each strut has an upper terminus 16 and 18, respectively. The termini 16 and 18 are connected in any suitable manner to a tray 21. The tray 21 is in a horizontal attitude, presenting an essentially flat surface 23 which may support incidental items and may be slightly dished without departure from the invention. The tray has a rear area 25, which receives the termini 16 and 18 in spaced relation, and a forward area 27 which is formed with a recess 30. A peg 22 is provided and may be used to hang one's bow when not in use.

The recess 30 is of such size and shape as to accommodate the neck, or finger-board of the instrument and, additionally, is padded as at 32, or at least covered with felt, or comparable soft material, so as to not mar the finish on the instrument. In this fashion, the instrument is stabilized, yet readily accessible.

In order, in keeping with the invention, to provide solid support for the instrument, all of the struts terminate in feet 39 at the bottom thereof which together form a triangle of support for the stand, thereby providing stability in all axes. By virtue of this configuration, the stand has three point support and is, consequently, stable in all axes.

Figure 2:
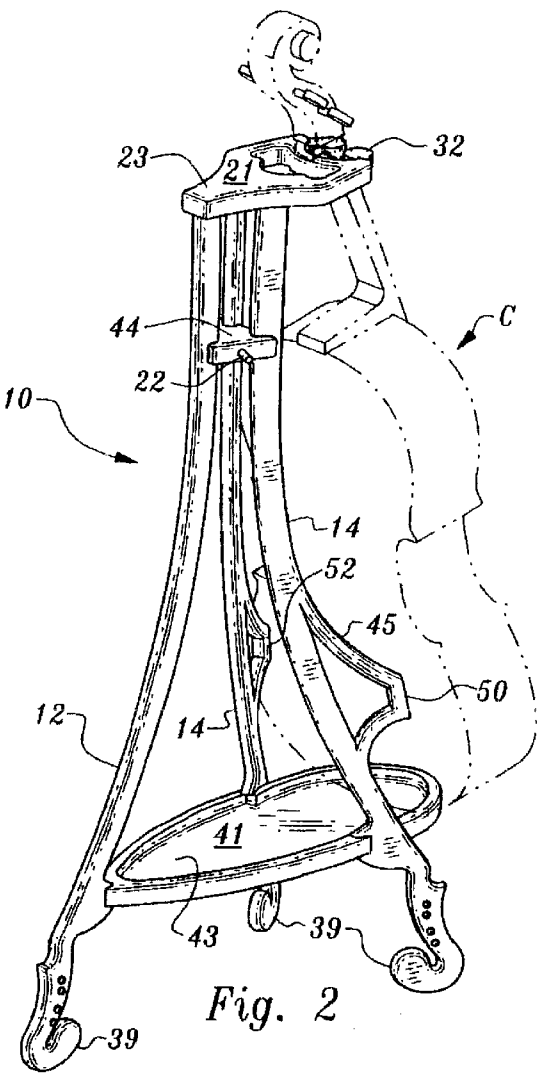
FIG. 2 is a right side elevation of the stand of the present invention, in the manner of FIG. 1, but with the instrument facing generally away from the viewer.

As a means of enhancing structural strength, as well as increasing overall utility, a shelf 41 is provided. The shelf is secured, in any suitable fashion, to and supported horizontally in a plane parallel to the tray, by the struts, above the feet thereof, as best seen in FIGS. 1 and 2, and presents an ample surface 43 upon which such things as sheet music, a bow and rosin may be situated when not in use. Additionally, a wedge 44 may be provided to add strength to the stand.

Further in keeping with the objects of the invention, the end pin, which is indigenous to such instruments as a cello and base, is easily positioned on the shelf to provide further support for the instrument at the appropriate height for ready access.

As a further adjunct to the utility of the stand of the present invention and to prevent inadvertent rotation of an instrument disposed thereon, opposed wings 45 and 47 are formed, or otherwise provided, respectively, on forward struts 14. Each of the wings comprises an outwardly extending framework which presents support surface 50 and 52, respectively, each of which are provided at the termini of each wing where they are intended to engage and support against inadvertent rotation, the body of an instrument while on the stand to effectively inhibit rotation thereof. The recess 30 and the support surfaces 50 and 52 are so positioned as to comfortably receive a stringed instrument against those surfaces. By padding, or providing a soft material cover on the support surfaces, damage to the finish of the instrument is effectively eliminated.

It will be appreciated that some deviation from the precise structure described and illustrated may be accomplished without departure from the invention.

Having thus described a preferred embodiment of the present invention, what is now claimed is:

1. A stable support for a stringed musical instrument comprising:

a plurality of upstanding struts, said struts having feet at one end thereof and being arcuate in shape; a tray, said tray being supported by said struts, said tray being formed with a forward area, said forward area having a recess therein;

wings extending outwardly from at least one of said struts, said wings having support surfaces defined thereon, for supporting, with said tray, a stringed instrument.

2. The support as set forth in claim 1, wherein said wings extend outwardly from adjacent struts.

3. The support as set forth in claim 1, wherein said struts comprise at least one rear said strut, and at least two forward said struts.

4. The support as set forth in claim 3, wherein said wings are disposed on said forward struts.

5. The support as set forth in claim 1, wherein a recess is formed in said tray to receive a portion of said stringed instrument therein.

6. The support as set forth in claim 5, wherein said recess is formed in said forward area.

7. The support as set forth in claim 1, wherein said wings provide support surfaces thereon.

8. The support as set forth in claim 1, wherein said wings terminate in support surfaces for receiving a portion of the stringed instrument.

9. The support as set forth in claim 7, wherein said support surfaces are provided with a soft material to prevent damage to an instrument supported thereon.

10. A stable support for a stringed musical instrument comprising:

a plurality of upstanding struts, said struts having feet at one end thereof, and being arcuate in shape; a tray, said tray being supported by said struts, said tray being formed with a forward area, said forward area having a recess therein;

a wedge, said wedge engaging each of said struts thereby enhancing structural strength.

11. The support as set forth in claim 10, wherein said wedge engages each of said struts in a single plane.

12. The support as set forth in claim 10, including a peg, said peg being mounted in and extending outwardly from said wedge.

13. The support as set forth in claim 10, wherein said struts comprise at least one rear said strut, and at least two forward said struts.

14. The support as set forth in claim 10, wherein said struts comprise at least one ear said strut, and at least two forward said struts and said wings are disposed on said forward struts.

15. The support as set forth in claim 10, wherein a recess is formed in said tray to receive a portion of said stringed instrument therein.

16. The support as set forth in claim 10, wherein said wings terminate in support surfaces for receiving a portion of the stringed instrument.

17. The support as set forth in claim 10, wherein said wings provide support surfaces thereon, said support surfaces being provided with a soft material to prevent damage to an instrument supported thereon.

* * * * *